US009280116B2

(12) United States Patent
Okada

(10) Patent No.: US 9,280,116 B2
(45) Date of Patent: Mar. 8, 2016

(54) IMAGE FORMING APPARATUS WITH FORCED TONER SUPPLY MODE

(71) Applicant: CANON KABUSHIKI KAISHA, Tokyo (JP)

(72) Inventor: Noriyuki Okada, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/459,807

(22) Filed: Aug. 14, 2014

(65) Prior Publication Data

US 2015/0050036 A1 Feb. 19, 2015

(30) Foreign Application Priority Data

Aug. 19, 2013 (JP) ..... 2013-169602

(51) Int. Cl.
*G03G 15/08* (2006.01)
*G03G 15/00* (2006.01)

(52) U.S. Cl.
CPC ..... *G03G 15/556* (2013.01); *G03G 15/0849* (2013.01); *G03G 15/0877* (2013.01)

(58) Field of Classification Search
CPC ..... G03G 15/0849; G03G 15/0877; G03G 15/556
See application file for complete search history.

(56) References Cited

U.S. PATENT DOCUMENTS 5,826,134 A * 10/1998 Hino et al. ..... 399/27
6,526,252 B1 * 2/2003 Itoh et al. ..... 399/359
6,577,824 B2 * 6/2003 Itoh et al. ..... 399/27
6,917,767 B2 * 7/2005 Kabashima ..... 399/27
6,999,689 B2 2/2006 Kinoshita et al.
7,110,684 B2 * 9/2006 Isobe et al. ..... 399/27
7,218,871 B2 * 5/2007 Ogata ..... 399/27
7,359,651 B2 4/2008 Nishitani et al.
7,856,189 B2 * 12/2010 Ishibashi ..... 399/61
8,233,811 B2 7/2012 Itoyama et al.

(Continued)

FOREIGN PATENT DOCUMENTS

JP 10-69161 A 3/1998
JP 3577861 B2 10/2004

(Continued)

OTHER PUBLICATIONS

Machine translation of JP2010160468.*

(Continued)

*Primary Examiner* — David Bolduc
(74) *Attorney, Agent, or Firm* — Fitzpatrick, Cella, Harper & Scinto

(57) ABSTRACT

An image forming apparatus includes: an image bearing member; a developing device; a supply device which supplies toner to the developing device; a density detector which detects information about a toner density as a ratio of toner and carrier of the developer of the developing device; and a controller which interrupts an image forming operation and is capable of executing a forced supply mode of performing the toner supply to the developing device from the supply device, based on first information of at least one of detection results of the density detector and information about a toner consumption, second information about the amount of supply operation supplied by the supply device, in which the controller determines whether or not to execute the forced supply mode, and third information about an accumulated value of the amount of toner consumption after the forced supply mode executed last time.

3 Claims, 13 Drawing Sheets

(56) References Cited

U.S. PATENT DOCUMENTS

| | | | | |
|---|---|---|---|---|
| 8,666,266 | B2 | 3/2014 | Ajima | |
| 2002/0025178 | A1* | 2/2002 | Suzuki | 399/30 |
| 2003/0072580 | A1* | 4/2003 | Itoh et al. | 399/62 |
| 2005/0063714 | A1 | 3/2005 | Kinoshita et al. | |
| 2006/0165423 | A1 | 7/2006 | Nishitani et al. | |
| 2009/0110414 | A1 | 4/2009 | Itoyama et al. | |
| 2009/0232531 | A1* | 9/2009 | Tonohiro et al. | 399/53 |
| 2011/0052221 | A1* | 3/2011 | Hirobe et al. | 399/27 |
| 2011/0262154 | A1 | 10/2011 | Ajima | |
| 2011/0305468 | A1* | 12/2011 | Fujiwara | 399/27 |
| 2013/0188973 | A1* | 7/2013 | Kusumoto | 399/27 |
| 2013/0230332 | A1* | 9/2013 | Ishii | 399/27 |
| 2013/0243450 | A1* | 9/2013 | Suenami | 399/27 |
| 2014/0126921 | A1* | 5/2014 | Onishi | 399/30 |
| 2014/0226995 | A1* | 8/2014 | Oida | 399/27 |
| 2015/0049364 | A1 | 2/2015 | Okada | |

FOREIGN PATENT DOCUMENTS

| | | | |
|---|---|---|---|
| JP | 2005-062848 | A | 3/2005 |
| JP | 2006-201314 | A | 8/2006 |
| JP | 2006-301537 | A | 11/2006 |
| JP | 2008-111880 | A | 5/2008 |
| JP | 2009-103970 | A | 5/2009 |
| JP | 4434256 | B2 | 3/2010 |
| JP | 2010-160468 | A | 7/2010 |
| JP | 2011-048201 | A | 3/2011 |
| JP | 4731918 | B2 | 7/2011 |
| JP | 5444950 | B2 | 3/2014 |

OTHER PUBLICATIONS

Search Report in European Patent Application No. 14180938.4, dated Mar. 4, 2015.

* cited by examiner

A = 0 IMAGE RATIO: 10%

A = 2046 IMAGE RATIO: 10%

A = 0 IMAGE RATIO: 80%

A = 2046 IMAGE RATIO: 80%

IMAGE FORMING APPARATUS WITH FORCED TONER SUPPLY MODE

BACKGROUND OF THE INVENTION

1. Field of the Invention

The present invention relates to an image forming apparatus such as a copying machine and a printer that uses an electrophotographic system or an electrostatic recording system.

2. Description of the Related Art

Among image forming apparatuses, digital laser beam printers of a so- called electrophotographic system have been known. In a development device equipped in the image forming apparatus, a one-component developer containing magnetic toner as a main component, or a two-component developer containing non-magnetic toner and magnetic carrier as main components has been used. In particular, in the image forming apparatus that forms a full-color or multi-color image, the two-component developer has been mainly used from the viewpoint of color of an image or the like.

There is a toner supply control as particular importance in the two-component developer. The two-component developer has the toner and the carrier, and when forming the image, a TD ratio as a ratio of the toner to the carrier changes by consumption of the toner. Since charging characteristics of the toner change depending on the value of the TD ratio, it is required to supply the toner so as to maintain the charging characteristics of the toner. A toner bottle configured to supply the toner is provided separately from the development device, and when there is no toner in the toner bottle, the toner bottle is replaced with a new one.

Furthermore, in recent years, there have been increased demands for size reduction and noise reduction of the image forming apparatuses. For example, as an example of the size reduction, as in US Patent Application Publication No. 2006/165423 A1, and Japanese Patent Laid-Open No. 2011-048201, in an image forming apparatus that forms a full color image, a size reduction of a supply motor configured to turn a toner bottle is achieved by using two colors by one motor. Here, in some cases, the supply cannot be kept up depending on the toner consumption of the common two colors, and since the TD ratio of the two-component developer is lowered at that time, the supply is implemented by providing downtime.

Furthermore, as examples of the noise reduction, by lowering the number of rotations of the supply motor, it is possible to use the smaller motors, thereby reducing the sound. Even at this time, in some cases, the supply cannot be kept up depending on the toner consumption, and since the TD ratio of the two-component developer is lowered at that time, it is necessary to carry out the supply by providing the downtime.

However, in some cases, the supply cannot be kept up depending on the toner consumption. In this case, a control is performed such that the control (forced supply sequence) of implementing the supply by providing the downtime is input, but the following problems may occur.

When a remaining amount of toner in the toner bottle decreases (just before toner absence), the toner capable of being supplied into the development device decreases. For this reason, even in the image with less toner consumption, the TD ratio of the two-component developer is lowered. In this case, since the amount of toner supply required for the image forming apparatus increases, the supply is not kept up for the required amount of supply, and the forced supply sequence starts.

However, even if the forced supply sequence is implemented, since the amount of toner to be supplied to the development device is small, the TD ratio of the two-component developer does not rise. For this reason, in some cases, the forced supply sequence may be repeatedly performed more than necessary. In this case, there has been a problem in that the downtime due to the forced supply sequence occurs frequently until "toner absence" is displayed.

SUMMARY OF THE INVENTION

It is desirable to suppress an occurrence of downtime by efficiently performing the control of the forced supply sequence.

As a typical configuration of the present invention for achieving the above-described purpose, an image forming apparatus includes:

an image bearing member;

a developing device which is provided with a developer bearing member that carries a developer, and develops an electrostatic image formed on the image bearing member;

a supply device which supplies toner to the developing device;

a density detector which detects information about a toner density as a ratio of toner and carrier of the developer of the developing device; and a controller which interrupts an image forming operation and is capable of executing a forced supply mode of performing the toner supply to the developing device from the supply device, based on first information of at least one of detection results of the density detector and information about a toner consumption, second information about the amount of supply operation supplied by the supply device, and third information about an accumulated value of the amount of toner consumption after the forced supply mode executed last time.

Further features of the present invention will become apparent from the following description of exemplary embodiments with reference to the attached drawings.

DESCRIPTION OF THE EMBODIMENTS

[First Embodiment]

Figure 2:
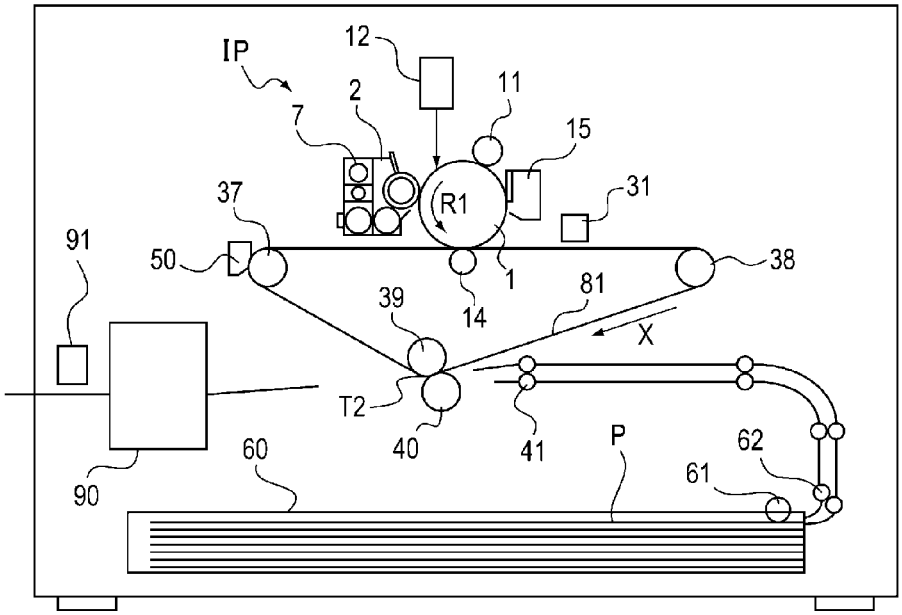
FIG. 2 is a schematic cross-sectional view illustrating an overall configuration of an image forming apparatus.

A first embodiment of the present invention will be described with reference to the drawings. FIG. 2 is a schematic cross-sectional view illustrating an overall configuration of an image forming apparatus. The image forming apparatus of this embodiment is an electrophotographic image forming apparatus of a digital type. Hereinafter, the image forming apparatus will be described in detail.

As illustrated in FIG. 2, an endless intermediate transfer belt (ITB) 81 that travels in a direction of an arrow X is disposed in the image forming apparatus. The intermediate transfer belt 81 is stretched by three rollers of a drive roller 37, a tension roller 38, and a secondary transfer inner roller 39.

A transfer material P taken out from a sheet cassette 60 is supplied to a conveying roller 61 via a pickup roller, and is conveyed to a left side in the drawings.

Figure 1:
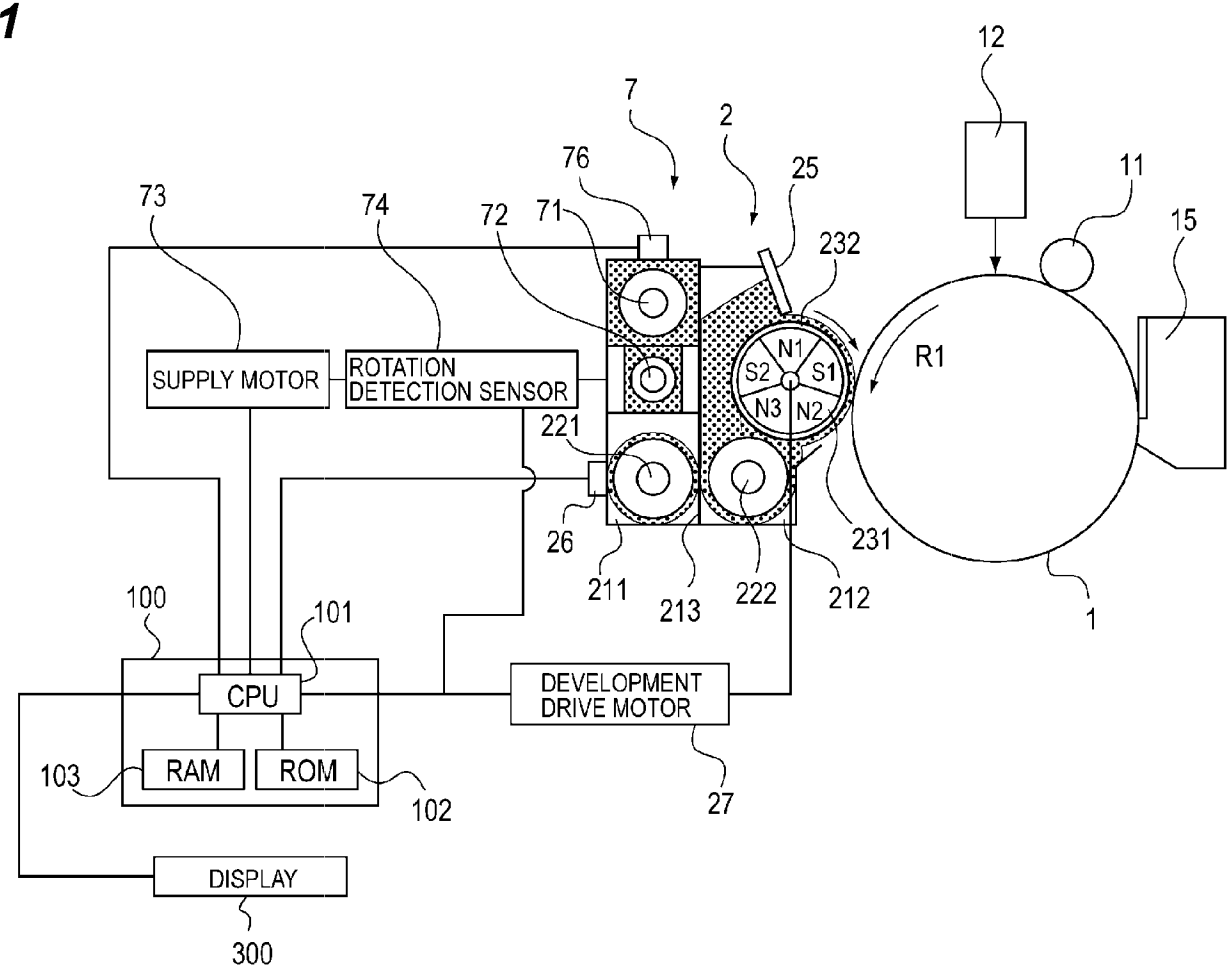
FIG. 1 is a cross-sectional view illustrating a detailed configuration of an image forming portion.

An image forming portion IP is disposed above the intermediate transfer belt 81. FIG. 1 is a cross-sectional view illustrating a detailed configuration of the image forming portion. The image forming portion is provided with a drum-shaped photosensitive drum 1 (image bearing member) that is disposed in a rotatable manner.

The photosensitive drum 1 has a support shaft (not illustrated) at a center thereof, and is rotationally driven by a drive section (not illustrated) around the support shaft in the direction of arrow R1. The rotational speed of the photosensitive drum 1 in this embodiment is 110 mm/s. Around the photosensitive drum 1, process devices such as a charging roller 11, a development device 2 (developing device), a primary transfer roller 14, and a cleaning device 15 are disposed.

The charging roller 11 (a primary charger) comes into contact with a surface of the photosensitive drum 1 to uniformly charge the surface to predetermined polarity and potential. The charging roller 11 is configured in a roller shape as a whole. The charging roller 11 is pressed against the surface of the photosensitive drum 1 with predetermined pressing force, and the charging roller 11 is driven to turn according to the rotation of the photosensitive drum 1 in the direction of arrow R1.

Bias voltage is applied to a metal core of the charging roller 11 by a charging bias power supply (not illustrated), thereby implementing the uniform contact charging of surface of the photosensitive drum 1.

In this embodiment, bias voltage obtained by superimposing 1.5 kVpp with DC voltage and AC voltage was applied to the metal core of the charging roller 11. By applying the AC voltage, it is possible to cause the potential on the photosensitive drum 1 to be converged to the same value as the voltage of the DC voltage. For example, the potential of the surface of the photosensitive drum 1 after charging at the time of the DC voltage=−600 V is −600 V.

A scanner 12 (exposure portion) is disposed on a downstream side of the charging roller 11. The photosensitive drum 1 is irradiated with laser beam depending on an image signal from the scanner 12. As a result, an electrostatic image is formed on the photosensitive drum 1.

Intensity of the laser beam of the scanner 12 can vary within a range of 0 to 255. By varying the intensity of laser beam, the latent image potential is changed. In this embodiment, the potential on the photosensitive drum 1 when the intensity of laser beam: L is changed to 0 to 255 is set to V (L) (V (L=0) to V (L=255)).

On the downstream side of the scanner 12, the development device 2 is disposed. Two-component developer using non-magnetic toner and magnetic carrier is housed in the development device 2. In this embodiment, a two-component developing method using the two-component developer was used. Furthermore, in this embodiment, a negatively charged toner was used.

The interior of the development device 2 is partitioned into a developing chamber 212 and a stirring chamber 211 by a partition wall 213 extending in a vertical direction.

A non-magnetic development sleeve 232 (a developer bearing member) is disposed on the developing chamber 212. A magnet 231 (magnetic field generating unit) is fixedly disposed in the development sleeve 232. The magnet 231 includes approximately three or more poles. In this embodiment, a 5-pole magnet was used. Thus, at least, as a development portion for developing an electrostatic latent image, the development device 2 and the development sleeve 232 are included.

A first conveying screw 222 and a second conveying screw 221 are disposed in the developing chamber 212 and the stirring chamber 211, respectively, as a developer stirring conveying unit.

The development sleeve 232, the first conveying screw 222, and the second conveying screw 221 are driven by a development drive motor 27.

The first conveying screw 222 stirs and conveys the developer of the developing chamber 212. Furthermore, the second conveying screw 221 stirs and conveys the toner supplied by the toner bottle 7, and the developer that is present in the development device 2 in advance. The uniform toner density of the developer in the development device 2 is obtained by the stirring conveyance.

An inductance sensor 26 (a density detector) is provided in the stirring chamber 211. The inductance sensor 26 detects the toner density (a ratio of toner and carrier: TD ratio) in the development device.

In the partition wall 213 between the stirring chamber 211 and the developing chamber 212, in the drawings, a developer passage is formed through which the developing chamber 212 and the stirring chamber 211 communicate with each other at the end of the front side and the back side. For this reason, the developer conveyed by the conveying force of the first conveying screw 222 and the second conveying screw 221 circulates between the developing chamber 212 and the stirring chamber 211 through the developer passage.

Specifically, after the toner is consumed by the development and the toner density of the developer is lowered, the developer of the developing chamber 212 moves to the stirring chamber 211 from one developer passage. Since the toner is supplied to the stirring chamber 211 from the toner bottle 7, the toner density of the developer is recovered in the stirring chamber 211. Moreover, the developer after the recovery of the toner density moves to the developing chamber 212 from the other developer passage.

The two-component developer stirred by the first conveying screw 222 in the development device 2 is conveyed by the rotation of the development sleeve 232, while being constrained by the magnetic force of a conveying magnetic pole for pumping (pumping pole) N3 of the magnet 231. Furthermore, the developer is fully restrained by a conveying magnetic pole (cut electrode) S2 having a flux density more than a certain level and is conveyed while forming a magnetic brush on the development sleeve 232.

Next, since the magnetic brush is ear-cut by the regulating blade 25, a thickness of a developer layer of the magnetic brush formed on the magnet 231 is adjusted to a proper length of the magnetic brush. Thereafter, along with the rotation of the conveying magnetic pole N1 and the development sleeve 232, the developer is conveyed to a development region facing the photosensitive drum 1. Here, the developer magnetic brush stands by the development pole S1 in the development region.

Moreover, by the development bias applied to the development sleeve 232, only the toner of the developer is transferred with respect to the electrostatic image on the photosensitive drum 1. Thus, the toner image corresponding to the electrostatic image is formed on the surface of the photosensitive drum 1.

A predetermined development bias is applied to the development sleeve 232 from a development bias power supply as a development bias output unit (not illustrated). In this embodiment, as the development sleeve 232, the development bias voltage obtained by superimposing the DC voltage (Dev DC=−500 V) and the AC voltage (Dev AC=1.3 KVpp) from a development bias power supply was used.

Figure 3:
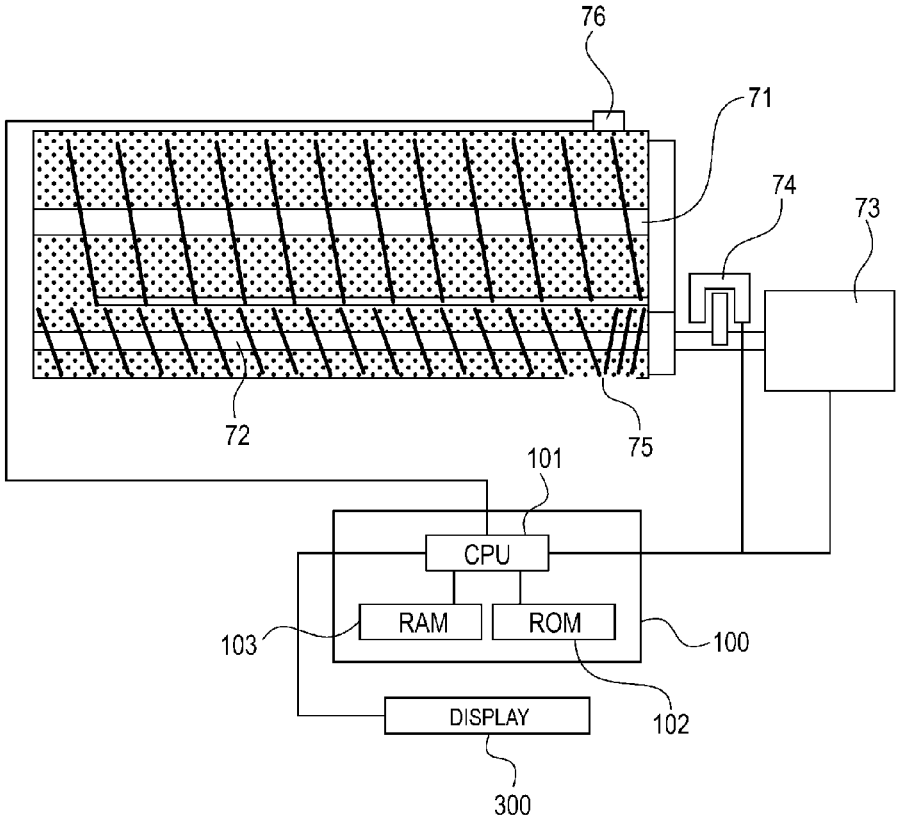
FIG. 3 is an explanatory view illustrating a configuration of a toner bottle.

The toner bottle 7 is attached to the development device 2 of the present embodiment. FIG. 3 is an explanatory diagram illustrating the configuration of the toner bottle.

As illustrated in FIG. 3, a supply motor 73 (a supply drive portion) is provided in the toner bottle 7 (supply device). A lower toner conveying screw 72 and an upper toner conveying screw 71 in the toner bottle 7 are rotated by the supply motor 73.

Moreover, when the supply motor 73 is driven, the lower toner conveying screw 72 rotates. The toner in the toner bottle 7 conveyed by the rotation of the lower toner conveying screw 72 is supplied to the development device 2 from a supply port 75 formed at the bottom of the toner bottle 7. By driving of the supply motor 73, the upper toner conveying screw 71 also rotates at the same time as the lower toner conveying screw 72 rotates, to convey the toner at the top of the toner bottle 7.

The control of each part of the device, such as the rotation control of the supply motor 73 and the calculation of the remaining supply amount, is implemented by a CPU 101 of the controller 100. Furthermore, the rotation detection of the supply motor 73 is implemented by the rotation detection sensor 74. The rotation detection sensor 74 is able to perform the detection as a unit of one rotation of the screw. The CPU 101 performs the control so as to rotationally drive the supply motor 73 by the predetermined rotation. The control results of the controller 100 are displayed as needed through a display device 300 such as a display.

A toner bottle absence and presence sensor 76 is disposed at the top of the toner bottle 7. The toner bottle absence and presence sensor 76 determines the presence or absence of the toner bottle 7.

As illustrated in FIG. 2, in the rotational direction of the surface of the photosensitive drum 1, a primary transfer roller 14 is disposed on the downstream side of the development device 2. Both ends of the primary transfer roller 14 are urged against the photosensitive drum 1 by a pressing member such as a spring (not illustrated).

On the downstream side of the rotational direction of the photosensitive drum 1 from the position of the primary transfer roller 14, a cleaning device 15 is disposed. A cleaning blade of the cleaning device 15 removes the toner remaining on the photosensitive drum 1.

An image density sensor 31 configured to detect the density of the toner image formed on the intermediate transfer belt 81 is installed on the intermediate transfer belt 81.

When the transfer material P taken out of the sheet cassette 60 is conveyed to the conveying roller 41, the leading end of the transfer material P is stopped once by the conveying roller 41. Moreover, the transfer material P is fed from the conveying roller 41 according to the timing such that the toner image formed on the intermediate transfer belt 81 can be transferred to a predetermined position of the recording material.

Next, in the transfer material P, in a region in which the secondary transfer inner roller 39 and a secondary transfer outer roller 40 abut against each other, the above-described four color toner images are transferred onto the transfer material P, by the secondary transfer bias applied to the secondary transfer outer roller 40.

A cleaning device 50 is disposed on the downstream of the secondary transfer inner roller 39 in the conveying direction of the intermediate transfer belt 81. The cleaning blade of the cleaning device 50 removes the toner remaining on the intermediate transfer belt 81.

The transfer material P separated from the intermediate transfer belt 81 is conveyed to a fixing device 90. The toner image transferred onto the transfer material P is heated and pressurized by the fixing device 90. Thus, the toner image melted and is fixed onto the transfer material P. In the image information of the transfer material P that is output, the image density is calculated by a video counter 91 (an image density calculation portion), and the data is transmitted to the controller as a video count value.

Thereafter, the transfer material P is discharged to the outside of the image forming apparatus. In this embodiment, the image forming apparatus is able to discharge an image of A4 size at a maximum rate of 25 sheets per minute.

(Toner Supply Control)

The details of the toner supply control according to this embodiment will be described.

By developing the electrostatic image and consuming the toner, the toner density of the developer in the development device 2 drops.

For this reason, the toner supply control of supplying the toner to the development device 2 from the toner bottle 7 is implemented by the density control device. Thus, the toner density of the developer is controlled to be as constant as possible or the image density is controlled to be as constant as possible.

In this embodiment, the supply control is implemented based on two pieces of information. A supply amount at the time of the N-th image formation will be described below.

A video count value: $V_c$ is first calculated from the image information of the N-th output, and the calculated video count value is multiplied by a coefficient: A ($V_c$) to calculate an amount of video count supply: M ($V_c$).

$$M(V_c)=V_c \times A(V_c) \quad \text{(Formula 1)}$$

Here, when the image of the image ratio: 100% (entire solid black) is output, the video count value: $V_c$=1023, and the video count value: $V_c$ varies depending on the image ratio.

Secondly, the amount of inductor supply: M (Indc) is calculated by Formula 2 described below, by multiplying a difference value between a TD ratio: TD (Indc) calculated from the detection result of the inductance sensor 26 at the N−1 sheet and a target TD ratio: TD (target) by a coefficient: A (Indc), thereby obtaining the detection result of the density detector.

$$M(Indc)=(TD(\text{target})-TD(Indc))\times A(Indc) \quad \text{(Formula 2)}$$

Here, coefficients: A ($V_c$) and A (Indc) are recorded in a ROM 102 in advance.

The target TD ratio: TD (target) is recorded in a RAM 103, and it is possible to change the setting value. In regard to a method of changing the target TD ratio: TD (target), in this embodiment, an image pattern (patch image) for detecting the image density is imaged for reference, and the image density is detected by the image density sensor 31 and is changed by the result thereof. The amount of toner supply: M is calculated by Formula 3 below, by obtaining two values of an amount of video count supply: M (Vc) as information about the toner consumption and an amount of inductor supply: M (Indc) as a detection result of the density detector.

$$M=M(V_c)+M(Indc)+M(\text{remain}) \quad \text{(Formula 3)}$$

Here, M (remain) is a remaining supply amount that remains without being able to perform the supply. The reason for an occurrence of the remaining supply amount is that, since the supply is implemented in units of one rotation of the screw, the supply amount less than one rotation which exceeds the supply capacity of one rotation of the screw remains as a remaining supply amount. A remaining supply amount calculation portion in the controller 100 calculates and integrates the remaining supply amount. The control of the remaining supply amount will be described below in detail.

Furthermore, in the case of M<0, M equals From Formula 3, even if M (Indc) equals 0, when the image ratio is high or the remaining supply amount is large, there is a case where the supply is implemented.

Next, a required number of rotations: Brq of the supply motor 73 is calculated from the amount of toner supply: M (first information). The supply amount: T to the development device per rotation of the lower toner conveying screw 72 is recorded in the ROM 102 in advance, and the required number of rotations: Brq of the supply motor 73 is calculated from the calculated amount of toner supply: M, by Formula 4 below.

$$\text{Brq}=\text{M/T} \quad \text{(Formula 4)}$$

Here, after the decimal point of Brq is rounded down, only an integer number part is used. In this embodiment, T=0.10 g is set.

In this embodiment, with respect to the required number of rotations: Brq, the number of rotations that can be actually supplied: implementation number of rotations: Bpr is calculated (second information about the amount of supply operation supplied by the supply device). The calculating method will be described later. The supply motor 73 is rotated in an amount of the implementation number of rotations: Bpr to perform the toner supply in one image formation.

The toner amount that could not be supplied in one image formation is assumed to be a remaining supply amount: M (remain), and is calculated by the following Formula 5, $$M(\text{remain})=M-Bpr\times T \quad \text{(Formula 5)}$$

(Toner Bottle: Determination of Toner Absence)

Hereinafter, a determining method in which the toner disappears (toner absence) in the toner bottle according to this embodiment will be described.

In this embodiment, when TD (Indc) N detected at the N-th time and the target TD ratio: TD (target) satisfy Formula 6 below three consecutive times, $$OTD \text{ ratio } N=TD(Indc)N-TD(\text{target})\geq -1.0\% \quad \text{(Formula 6)},$$

the image formation is interrupted.

Moreover, a toner bottle replacement instruction: "please replace the toner bottle" is displayed on the display device 300 to prohibit the image forming operation.

The value of −1.0% of Formula 6 and the conditions when Formula 6 are satisfied three consecutive times can also be other numbers.

Furthermore, when satisfying Formula 6 three consecutive times, in order to interrupt the image formation and determine that there is no toner in the toner bottle 7, it is also possible to perform the toner remaining amount checking sequence. Here, the toner remaining amount checking sequence is a sequence that performs the supply by the supply motor 73, drives the development drive motor 27, observes the detection result of the inductance sensor 26 after the supply, and determines the presence or absence of the toner in the toner bottle 7.

(Forced Supply Sequence)

The forced supply sequence (forced supply mode) capable of being executed by the controller of the present embodiment will be described. In this embodiment, the number of rotations: B of the supply motor 73 is calculated from the amount of toner supply: M to execute the supply. In this embodiment, in order to reduce the size, the sound and the cost of supply motor 73, the supply motor 73 is set to the rotational speed that can only be up to two rotations in one image formation.

This is due to the fact that the time required for the image forming apparatus of this embodiment to output a sheet of transfer material of A4 size during continuous driving is 2.4 seconds, whereas the rotational speed of the supply motor 73 drops to 60 rpm, and thus, the supply motor 73 is rotated only once per second.

In this embodiment, the toner consumption at the time of the entire solid image output of A4 size of the image ratio: 100% is about 0.35 g, whereas the amount of toner supply when the toner bottle 7 rotates once is about 0.10 g. In this case, since the supply motor 73 can rotate only up to twice in one image formation, the maximum supply amount becomes 0.20 g and is not enough in an amount of 0.15 g. Since this amount of 0.15 g cannot be supplied (remaining supply amount), when the remaining supply amount reaches a predetermined value, a method for compensation is taken by implementing the forced supply sequence. The forced supply sequence in this embodiment will be described below based on the above-described configuration.

Figure 4A:
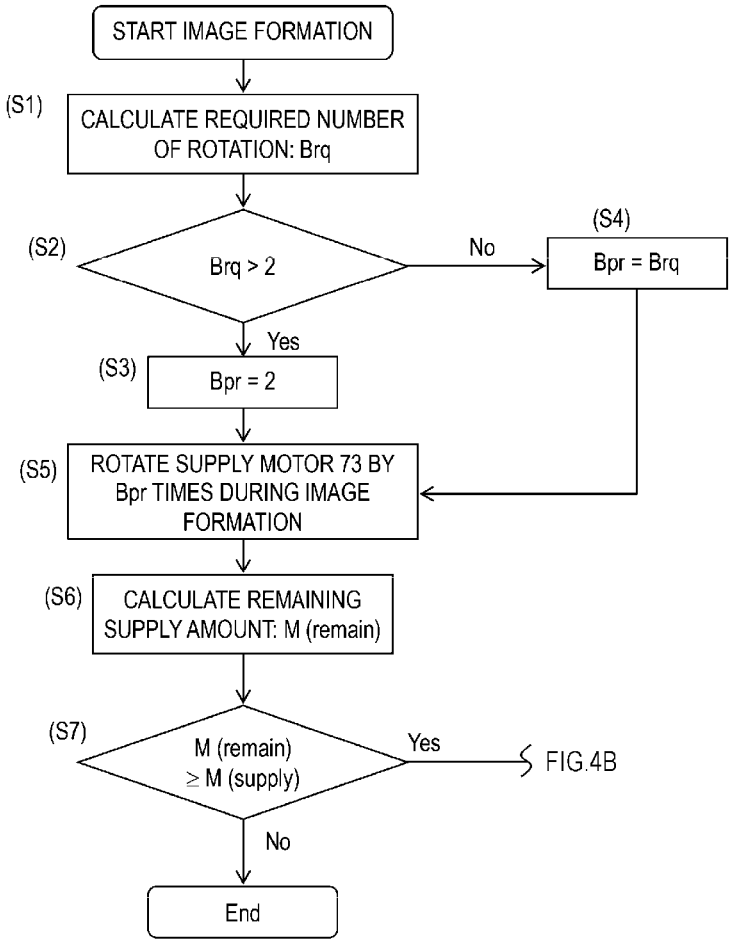
FIGS. 4A and 4B comprise a flowchart of the forced supply sequence of a first embodiment.
Figure 4B:
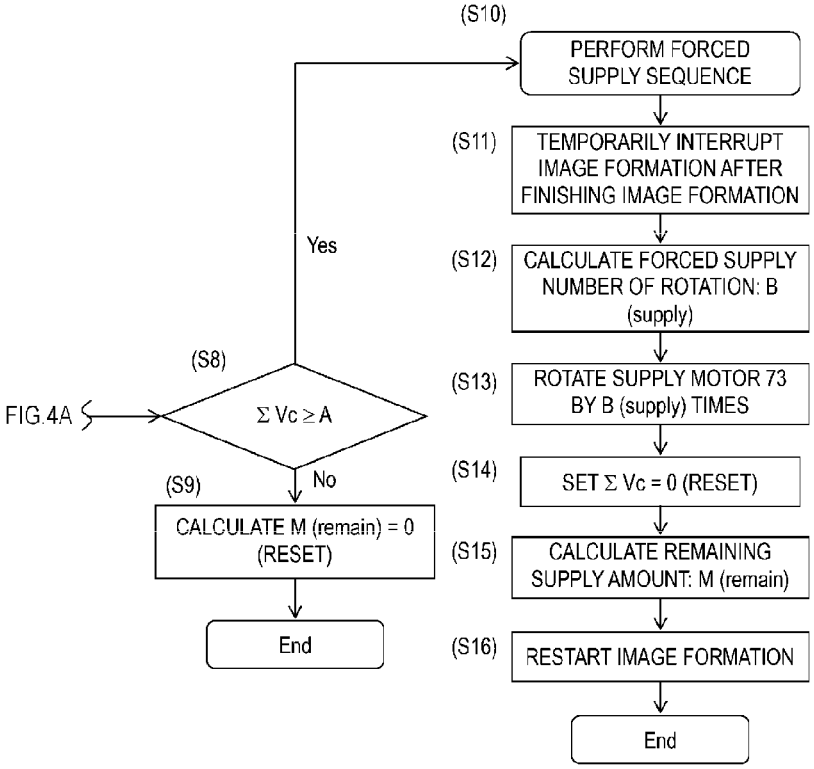

FIGS. 4A and 4B comprise a flowchart of the forced supply sequence of the first embodiment. First, the required number of rotations: Brq is calculated from Formula 4 above before the start of the image formation (S1).

Next, the number of rotations capable of being actually supplied, that is, the implementation number of rotations: Bpr is calculated from the calculated value of Brq. Specifically, when Brq is greater than 2 (S2), Bpr becomes 2 (S3). Meanwhile, when Brq is 2 or less, Bpr=Brq is calculated (S4).

By the calculated value of Bpr, the supply motor 73 at the time of image formation is rotated by the value of Bpr to perform the toner supply (S5). Next, the remaining amount of supply: M (remain) that could not be supplied in one image formation is calculated from Formula above (S6).

Moreover, it is determined whether the calculated remaining supply amount: M (remain) satisfies the relation of Formula 7 below (S7), $$M(\text{remain})\geq M(\text{supply}) \quad \text{(Formula 7)}$$

Here, M (supply) is an allowable value of toner to be supplied at least, and is a predetermined value capable of being set in advance by a user.

When not satisfying Formula 7, after the completion of the image formation, the next image formation can be continuously performed without performing the forced supply sequence.

Meanwhile, when satisfying Formula 7, it is necessary to supply the toner that could not be supplied, by implementing the forced supply sequence.

M (supply) is recorded in the ROM 102 in advance. In the present embodiment, M (supply) was set to 0.70 g, but it may be other values. It is necessary to determine M (supply) in consideration of the influences of image density or the like due to the fact that toner cannot be supplied.

As illustrated in FIGS. 4A and 4B, in this embodiment, prior to performing the forced supply sequence, one determination formula is input (S8). This is a feature of the present embodiment, and the problem is solved by implementing this process.

In the process of step (S8), first, the video count values notified after executing the preceding forced supply sequence (preceding forced supply mode) last time are integrated to calculate an integrated video count value: $\Sigma V_c$ (third information). The integrated video count value: $\Sigma V_c$ is the toner consumption after executing the preceding forced supply sequence last time.

Next, in the process of step (S8), it is determined whether the value of $\Sigma V_c$ is a predetermined value or more as compared to a predetermined value: A. Moreover, when the toner consumption is a predetermined value or more, the forced supply sequence is implemented. Meanwhile, when the toner consumption is less than a predetermined value, the forced supply is not implemented. In this embodiment, it is assumed that A=2046, but it may be other values.

After implementing the preceding forced supply sequence, even though the toner consumption is small, the forced supply sequence may be determined to be performed. However, under the condition that the normal toner is supplied from the toner bottle 7, such a determination is unlikely to be performed. Nevertheless, the reason why such a determination is made is that the toner in the toner bottle 7 decreases, and an amount of toner supply at the time of one rotation of the supply motor 73 is lowered.

Figure 5:
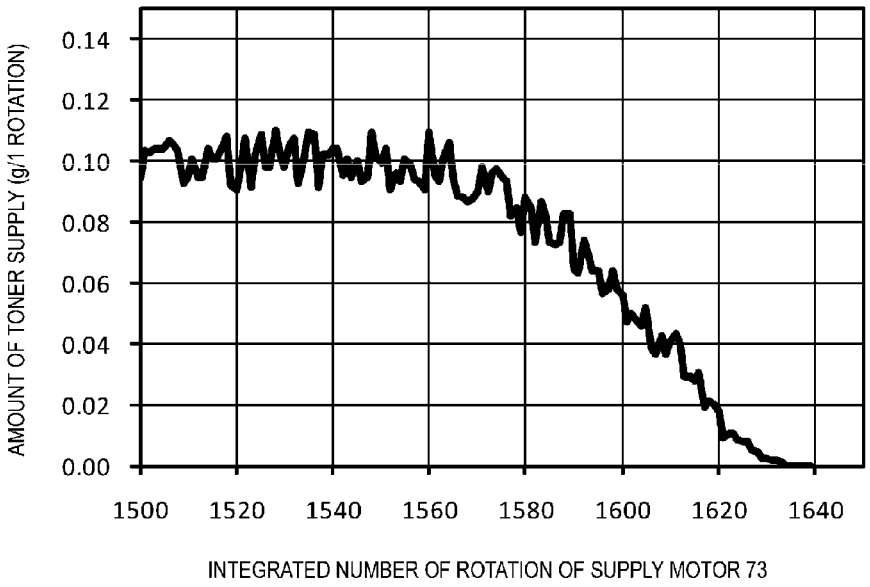
FIG. 5 is a graph illustrating a relation between an integrated number of rotations of a supply motor and an amount of toner supply of the first embodiment.

FIG. 5 is a graph illustrating a relation between the integrated number of rotations of the supply motor and the amount of toner supply of the first embodiment. FIG. 5 illustrates the amount of toner supply per rotation of the supply motor 73 with respect to the integrated number of rotations of the supply motor 73.

As illustrated in FIG. 5, from the vicinity of the point at which the integrated number of rotations of the supply motor 73 exceeds 1560 rpm, the amount of toner supply decreases. Moreover, when the integrated number of rotations of the supply motor 73 is around 1640 rpm, the amount of toner supply becomes zero.

In this embodiment, the toner is filled into the toner bottle 7 in an amount of 170 g, and in a state in which the amount of toner supply becomes zero in the vicinity of the point at which the integrated number of rotations of the supply motor 73 is 1640 rpm, the toner amount in the toner bottle 7 is about 10 g. The toner of 10 g is present in a gap among the upper toner conveying screw 71, the lower toner conveying screw 72, and the toner bottle 7, and cannot be sent in the conveyance of the screw. For this reason, the toner of 10 g may remain in the toner bottle 7.

As described above, from the vicinity of the point at which the integrated number of rotations of the supply motor 73 exceeds 1560 rpm, when the supply motor 73 rotates once, the amount of toner supply decreases. For this reason, even though the amount of toner consumption after implementation of the preceding forced supply sequence is small, it is determined that the forced supply sequence needs to be implemented in some cases. However, since the amount of toner supply drops, even if the forced supply sequence is implemented, the amount of toner to be supplied is small, and the TD ratio of the two-component developer in the development device 2 is not recovered in some cases.

When the TD ratio of the two-component developer is not recovered, the frequency of the forced supply sequence rises, and the downtime may become longer. When implementing the forced supply sequence under the conditions that the recovery of the TD ratio of the two-component developer is not expected, a disadvantage of the downtime increases. For this reason, it is necessary to reduce the frequency of the forced supply sequence as much as possible.

For this reason, in step (S8) in FIG. 4B, only when the integrated video count value: $\Sigma V_c$ is a predetermined value: A or more, the forced supply sequence (S10) is implemented.

Meanwhile, when the integrated video count value: $\Sigma V_c$ is less than a predetermined value: A, the forced supply sequence is not implemented, and the remaining supply amount: M (remain) is reset (S9). In this case, after the completion of the image formation without performing the forced supply sequence, the next image formation is prepared.

The reason of resetting the remaining supply amount: M (remain) in step (S9) is as follows. That is, since the remaining supply amount: M (remain) is only added when the remaining supply amount is not reset, thereafter, the number of rotations of the supply motor 73 when implementing the forced supply sequence becomes excessively large.

When implementing the forced supply sequence (S10), after the completion of the image formation, the image formation is temporarily interrupted (S11).

Next, the forced supply number of rotations: B (supply) of the supply motor 73 is calculated by the following formula from the remaining amount of supply: M (remain) (S 12).

$$B(\text{supply})=M(\text{remain})/T \qquad \text{(Formula 8).}$$

Thereafter, the supply motor 73 is rotated by the value of the forced supply number of rotations: B (supply) calculated in Formula 8 (S 13).

Thereafter, the integrated video count value: $\Sigma V_c$ is reset ($\Sigma V_c$=0) (S14), and after the remaining amount of supply: M (remain) is calculated again (S15), the image formation is resumed (S16).

Figure 6:
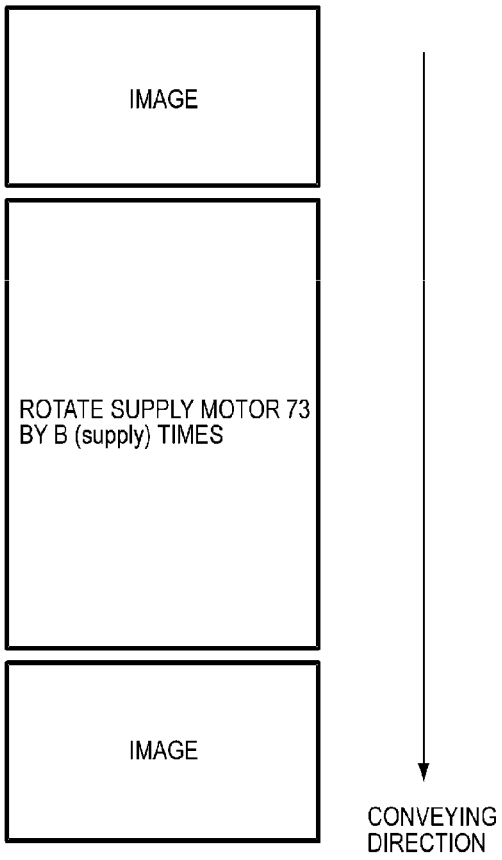
FIG. 6 is a conceptual diagram illustrating an image state when implementing the forced supply sequence.

FIG. 6 is a conceptual diagram illustrating the image state when carrying out the forced supply sequence. As illustrated in FIG. 6, when implementing the forced supply sequence, the gap generates between the image and the image. Meanwhile, when it is determined that the forced supply is not implemented by the control of step (S8), after the completion of the preceding image formation, it is possible to immediately continue the image formation.

In addition, when the determination of "toner absence" using Formula 6 and the determination "implementation of forced supply sequence" (S10) are performed during the same image formation, in this embodiment, "forced supply sequence" is not implemented, and "toner absence" is put out earlier. However, it is also possible to implement the "forced supply sequence" without being limited thereto.

Figure 7A:
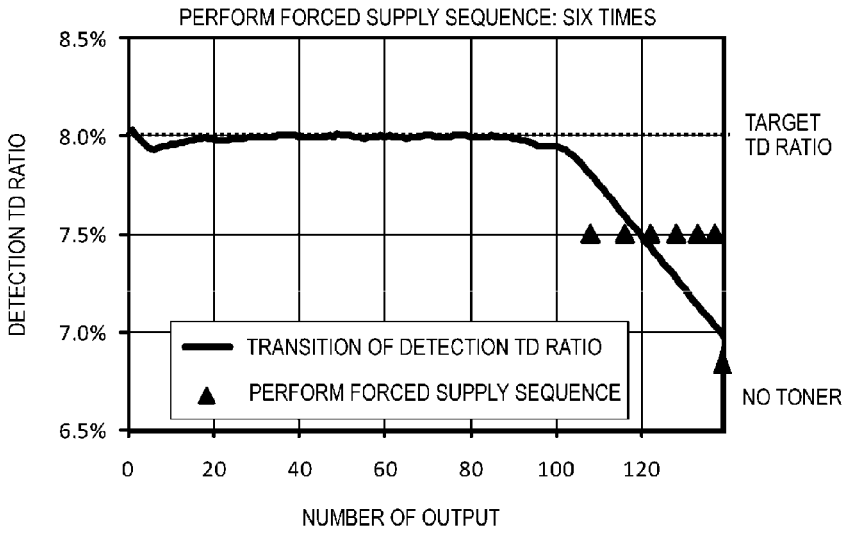
FIGS. 7A and 7B are graphs in which a conventional example is compared to the first embodiment at an image ratio of 10%.
Figure 7B:
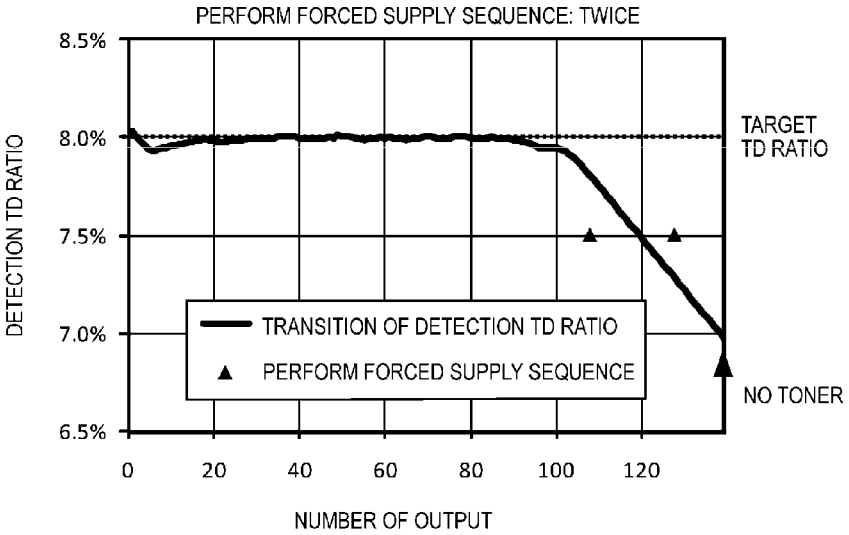

Next, the effect of the present embodiment will be described. FIGS. 7A and 7B are graphs in which the conventional example and the first embodiment are compared to each other at the image ratio of 10%. In FIGS. 7A and 7B, FIG. 7A indicates the time of A=0 as a conventional configuration example, and FIG. 7B indicates the time of A=2046 as the first embodiment. Furthermore, FIGS. 7A and 7B illustrate the transition of the detection TD ratio of the inductance sensor 26 just before the toner bottle 7 becomes a toner absence when outputting the image having the image ratio of 10%. In FIGS. 7A and 7B, the forced supply sequence is implemented at the time of the black triangle.

As illustrated in FIGS. 7A and 7B, in the conventional example of FIG. 7A, the forced supply sequence is implemented six times until becoming the toner absence, in spite of the image ratio of 10%. Moreover, even when implementing the forced supply sequence, the recovery behavior is not observed in the detection TD ratio. Meanwhile, in the present embodiment of FIG. 7B, the number of times of implementation of the forced supply sequence is suppressed to two times until becoming the toner absence.

In addition, under both conditions A=0 of FIG. 7A and A=2046 of FIG. 7B, the amount of toner supply of the toner bottle 7 is approximately zero. Furthermore, the remaining amount of toner of the toner bottle 7 is 10.2 g at the time of A=0 of FIG. 7A, meanwhile, the remaining amount of toner is also 10.3 g at the time of A=2046 of FIG. 7B, and there was substantially no difference. From the above-described results, it was possible to perform the control so as to reduce the number of times of implementation of the forced supply sequence from six times to two times, without changing the remaining amount of toner of the toner bottle 7.

Figure 8A:
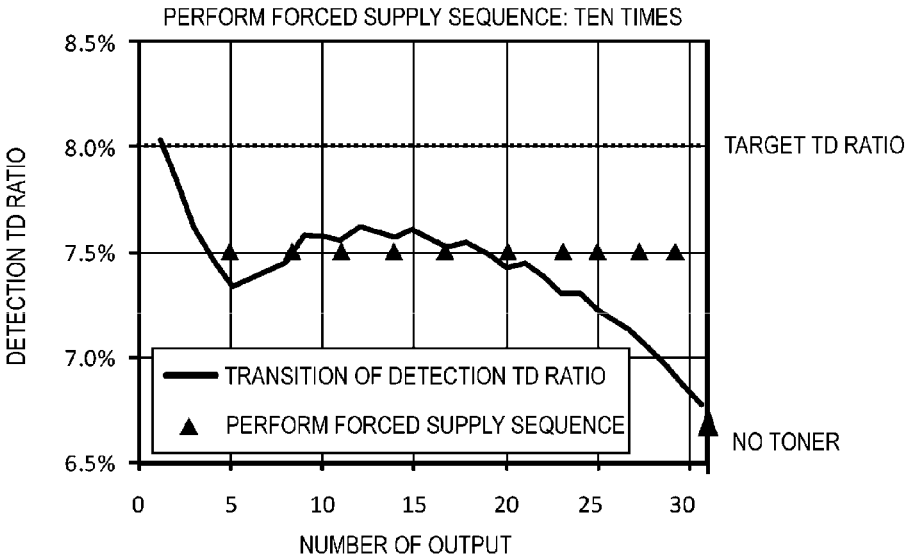
FIGS. 8A and 8B are graphs in which a conventional example is compared to the second embodiment at the image ratio of 80%.
Figure 8B:
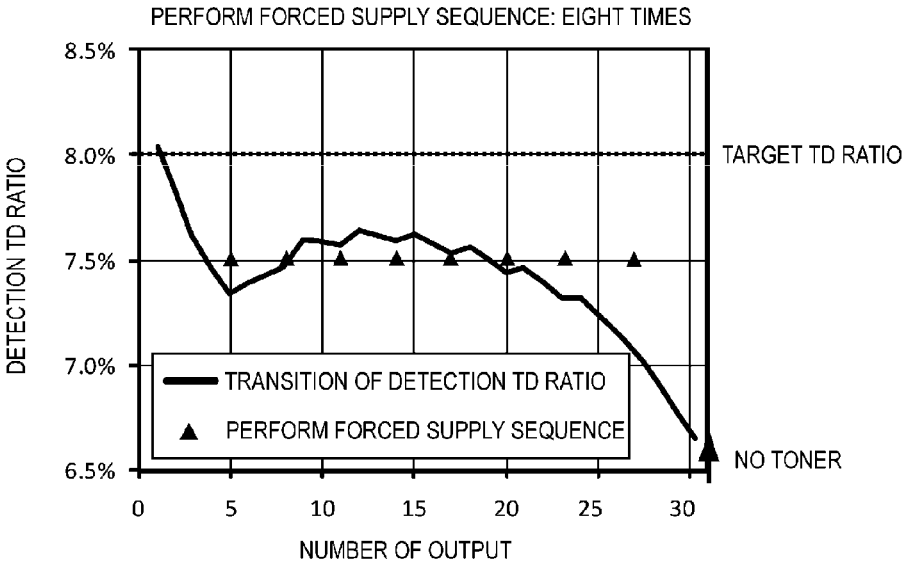

FIGS. 8A and 8B are graphs in which the conventional example and the first embodiment at the image ratio of 80% are compared to each other. In FIGS. 8A and 8B, FIG. 8A indicates A=0 as the conventional configuration example, and FIG. 8B indicates A=2046 as the first embodiment. Furthermore, FIGS. 8A and 8B illustrate the transition of the detection TD ratio of the inductance sensor 26 just before the toner bottle 7 becomes the toner absence when outputting the image having the image ratio of 80%.

As illustrated in FIGS. 8A and 8B, it was possible to suppress the number of times of implementation of the forced supply sequence from ten times to eight times, by performing the control of this embodiment.

Meanwhile, at the image ratio of 80%, the recovery of the TD ratio of the two-component developer is observed after implementation of the forced supply sequence. Under this influence, by implementing the control of this embodiment, the number until the toner absence is slightly reduced. Furthermore, since the remaining amount of toner of the toner bottle 7 at the time of toner absence is 10.6 g in the case of A=0 in FIG. 8A, and the remaining amount of toner is 11.0 g in the case of A=2046 in FIG. 8B, by implementing the control of the first embodiment, there is tendency that the amount somewhat increases.

[Second Embodiment]

A second embodiment of the present invention will be described. The same configuration as the first embodiment will not be described.

As illustrated in FIGS. 8A and 8B, when the image ratio is high, the effect of reducing the number of times of implementation of the supply forced sequence is obtained, but there is an influence that slightly increases the remaining amount of the toner. Meanwhile, under the conditions that the recovery of the TD ratio of the two-component developer after implementing the forced supply sequence, such as the image ratio of 10%, is not expected, even if the forced supply sequence is performed zero, there is no effect of the remaining amount of toner. For this reason, it is an ideal method to perform the forced supply sequence zero.

Therefore, in the second embodiment, the control is implemented so that, by changing the determination formula at (S8) of FIG. 4B in the first embodiment, the forced supply sequence is not implemented when the image ratio is low, and an increase in the remaining amount of toner is suppressed as much as possible when the image ratio is high.

Figure 9A:
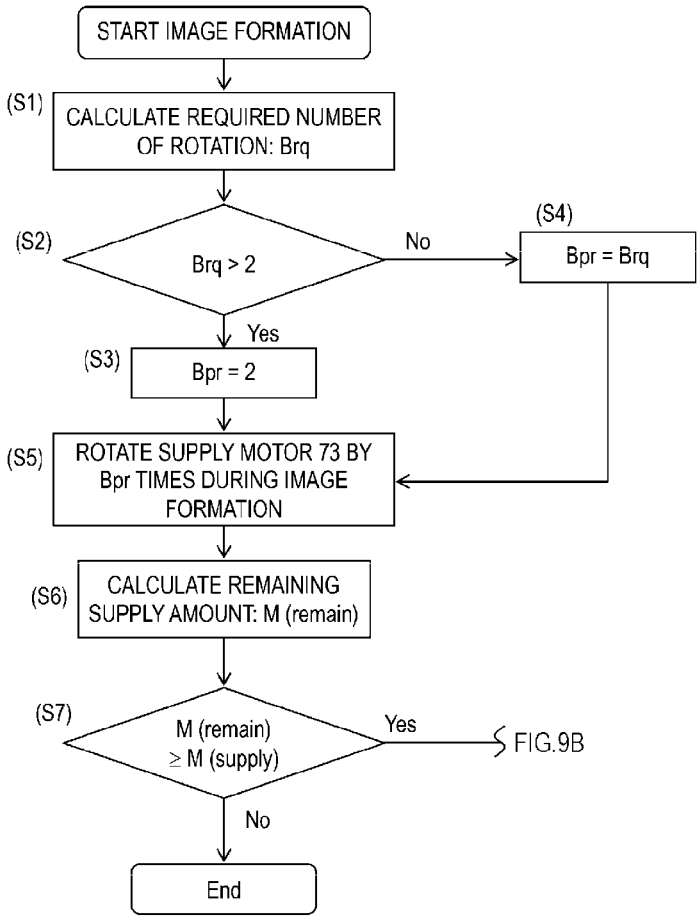
FIGS. 9A and 9B comprise a flowchart of the forced supply sequence of a second embodiment.
Figure 9B:
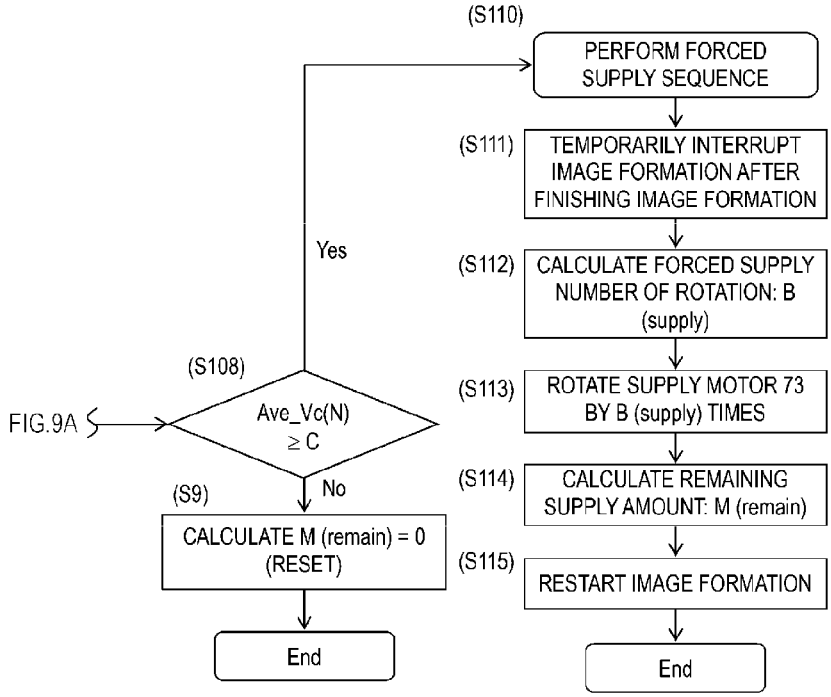

FIGS. 9A and 9B comprise a flowchart of the forced supply sequence of the second embodiment. FIGS. 9A and 9B are different from FIGS. 4A and 4B in the steps of the execution condition of the forced supply sequence, that is, in the step (S108) of FIG. 9B and the step (S8) of the first embodiment. Furthermore, the difference is that the reset process of the integrated video count value: $\Sigma V_c$ of step (S14) in the first embodiment is removed in the second embodiment.

In FIGS. 9A and 9B, steps from step (S1) to step (S7) and step (S9) are the same as those of the first embodiment. In the second embodiment, after step (S7), a movement average value: $A_{ve_}V_c$ of the video count value of the past M sheet (predetermined number of sheet) is first calculated, rather than the integrated video count value: $\Sigma V_c$. Moreover, it is determined whether to perform the forced supply sequence using the calculated value (S108).

By calculating $A_{ve_}V_c$, it is possible to calculate average toner consumption per sheet, and the implementation determination of the forced supply sequence is performed when the value is a predetermined value or less. This is because it is possible to determine that a drop of the amount of toner supply due to a decrease in the toner amount in the toner bottle 7 occurs.

The value of M can be set in the range in which the average toner consumption in the latest predetermined number is known, the value of M is set to M=8 in this embodiment, but it may be other values. Furthermore, in this embodiment, $A_{ve_}V_c$ is calculated by a modified movement average method, but it is intended to consider the recording capacity of the RAM 103, and it may be calculated by a normal movement average method.

The method of calculating the movement average value: $A_{ve_}V_c$ of the video count value of the past M sheet will be described.

The movement average value: $A_{ve_}V_c$ (N) of the video count value of the past M sheet after the completion of N−1 is calculated from Formula 9 below. In calculating the value, the values of the video count value: Vc (N) at the time of N-th image formation, q and the movement average value: $A_{ve_}V_c$ (N−1) of the video count value of the past M sheet at the time of completion of N−1 are used.

$$A_{ve_}V_c(N)=(M-1)/M\times A_{ve_}V_c(N-1)+1/M\times V_c(N) \quad \text{(Formula 9)}$$

In step (S108) in FIG. 9B, when the movement average value: $A_{ve_}V_c$ (N) of the video count value of the past M sheet is a predetermined value or more (C or higher), the forced supply sequence is implemented (S110).

Meanwhile, when $A_{ve_}V_c$ (N) is less than the predetermined value (less than C), the forced supply sequence is not implemented, and the remaining supply amount: M (remain) is reset (S9). Moreover, it is possible to continuously perform the image formation as it is after the completion of image formation.

Here, the reasons for resetting the remaining supply amount: M (remain) are as follows. That is, since the remaining supply amount: M (remain) is rapidly added, the number of rotations of the supply motor 73 when implementing the forced supply sequence increases too much unless the remaining supply amount is reset.

The subsequent flow, that is, the processes from step (S110) to step (S115) are the same as those of the first embodiment. Here, as described above, the process corresponding to step (S14) in FIG. 4B is cancelled. The reason is that, even if $A_{ve_}V_c$ (N) is not reset, since the value increases or decreases in the video count value during subsequent image formation, there is no need for reset.

Figure 10A:
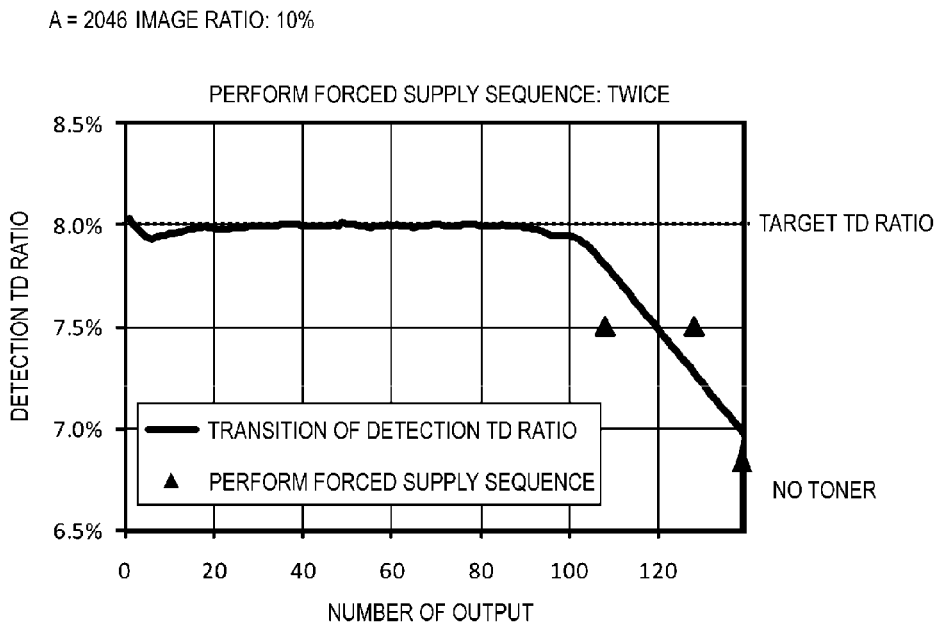
FIGS. 10A and 10B are diagrams illustrating an effect at the image ratio 10% of the second embodiment.
Figure 10B:
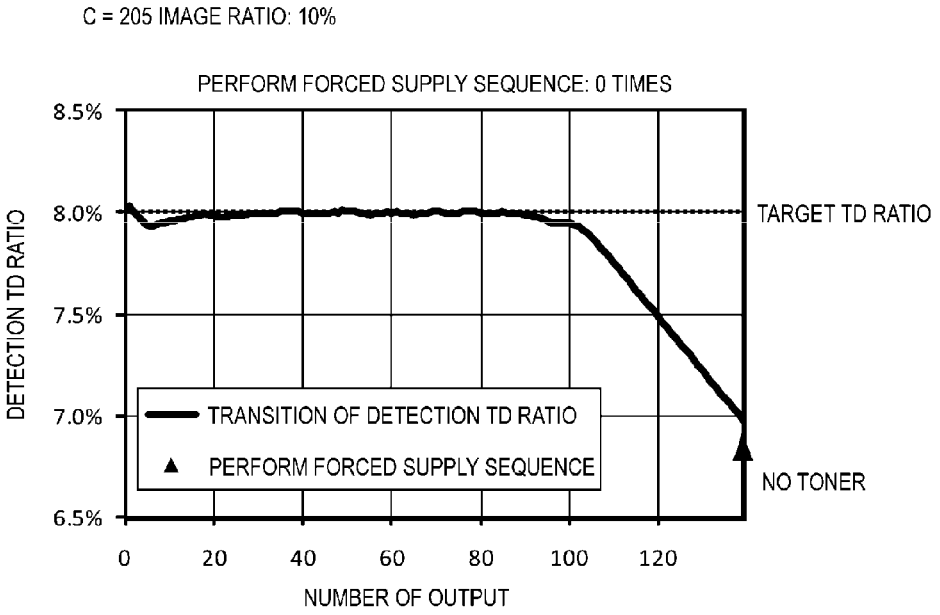

Hereinafter, the effect of the second embodiment will be described. FIGS. 10A and 10B are diagrams illustrating the effect at the image ratio of 10% of the second embodiment. FIGS. 10A and 10B illustrate the transition of the detection TD ratio of the inductance sensor 26 just before the toner bottle 7 becomes the toner absence when outputting the image having the image ratio of 10%. Moreover, FIG. 10A is a case of A=2046 in the configuration of the first embodiment as a comparative example, and FIG. 10B is a case of C=205 in the configuration of the second embodiment. In addition, in FIGS. 10A and 10B, the forced supply sequence is implemented at the time of black triangle.

From the comparison of FIGS. 10A and 10B, in the configuration of the second embodiment, it was possible to set the number of times of implementation of the forced supply sequence to zero. Furthermore, as the remaining amount of toner of the toner bottle 7 at that time, the amount is 10.2 g in the case of A=2046 in FIG. 10A, the amount is 10.1 g in the case of C=205 in FIG. 10B, and thus, there is substantially no difference. Thus, in the configuration of the second embodiment, at the time of the low image ratio, it is possible to reduce the number of times of implementation of the forced supply sequence.

Figure 11A:
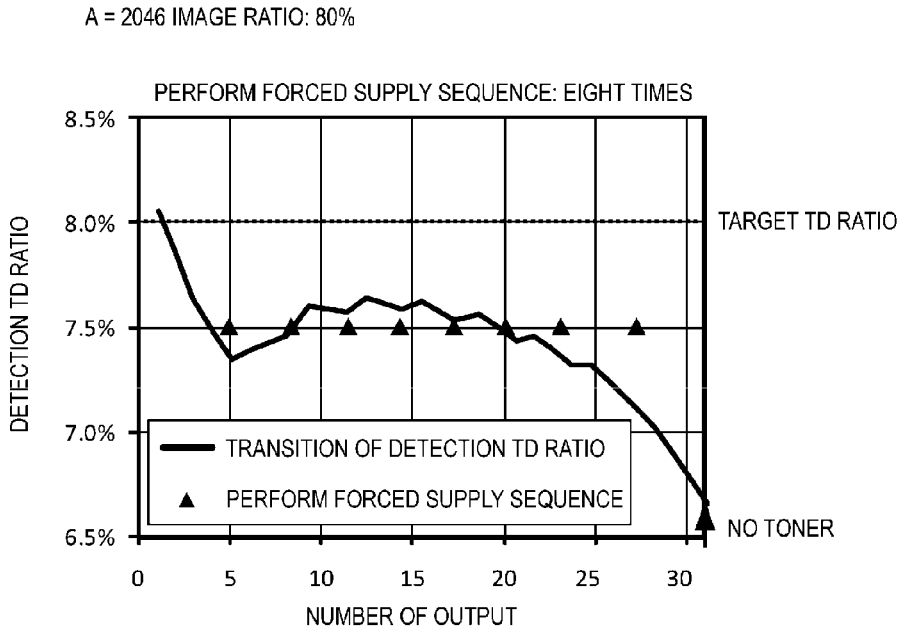
FIGS. 11A and 11B are diagrams illustrating an effect at the image ratio 80% of the second embodiment.
Figure 11B:
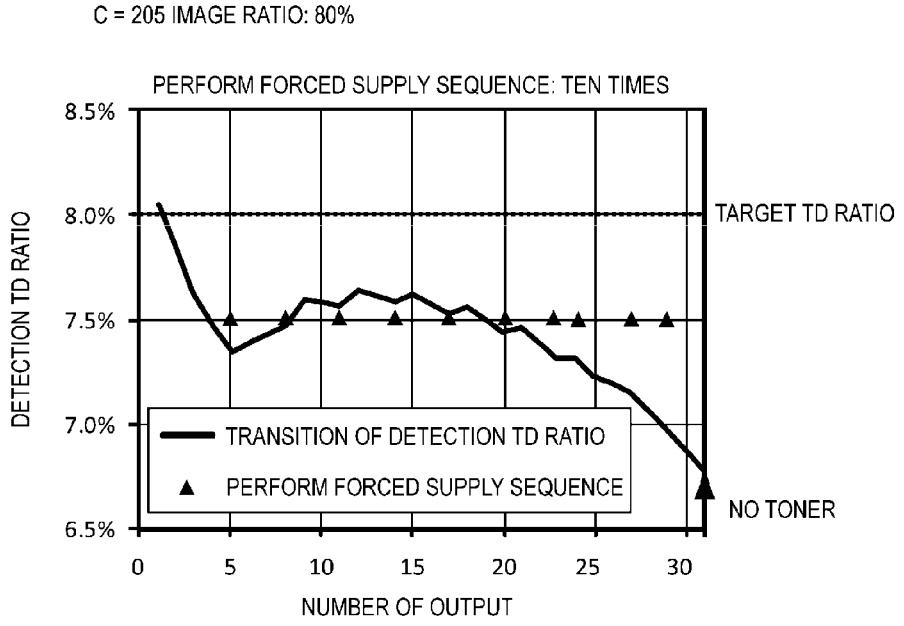

Next, FIGS. 11A and 11B are diagrams illustrating the effect at the image ratio of 80% of the second embodiment. FIGS. 11A and 11B illustrate the transition of the detection TD ratio of the inductance sensor 26 just before the toner bottle 7 becomes the toner absence when outputting the image having the image ratio of 80%. Moreover, FIG. 11A is a case of A=2046 in the configuration of the first embodiment as a comparative example, and FIG. 11B is a case of C=205 in the configuration of the second embodiment. In addition, in FIGS. 11A and 11B, the forced supply sequence is implemented at the time of black triangle.

From FIGS. 11A and 11B, in the configuration of the second embodiment, the number of times of implementation of the forced supply sequence increases to ten times of FIG. 11B as compared to eight times in FIG. 11A. However, as compared to 11.1 g in the case of A=2046 in FIG. 11A, the remaining amount of toner of the toner bottle 7 at that time decreases to 10.5 g in the case of C=205 in FIG. 11B. That is, the configuration of the second embodiment obtains the effect of reducing the remaining amount of toner.

Thus, in the configuration of the second embodiment, there is an effect in which, at the time of the high image ratio, the number of times of implementation of the forced supply sequence is maintained in the same manner as the conventional configuration, and it is possible to reduce the remaining amount of toner in the toner bottle 7. In this embodiment, the supply control was performed based on two pieces of information. That is, the supply amount is determined, based on the video count value as the image information, and the detection result of the inductance sensor 26, but is not limited thereto. The supply control may be performed based on at least a piece of information of the video count value and the detection results of the inductance sensor 26.

According to the above-described configurations, by efficiently performing the control of the forced supply sequence, it is possible to suppress the occurrence of downtime.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-169602, filed Aug. 19, 2013, which is hereby incorporated by reference herein in its entirety.

What is claimed is:

1. An image forming apparatus comprising:

an image bearing member;

a developing device configured to develop an electrostatic image formed on the image bearing member, the developing device including a developer bearing member configured to carry a developer;

a supply device configured to supply toner to the developing device;

a density detector configured to detect information about a toner density as a ratio of toner and carrier of the developer of the developing device; and a controller configured to execute a forced supply mode of performing the toner supply to the developing device from the supply device, wherein the controller interrupts an image forming operation and executes the forced supply mode when both of the following conditions (i) and (ii) are satisfied in a job in which image formation is continuously performed on a plurality of recording materials:

(i) a remaining supply amount obtained based on first information of at least one of detection results of the density detector and information about a toner consumption and second information concerning a driving amount of the supply device is greater than a first predetermined amount, (ii) an accumulated amount of toner consumed after the forced supply mode is executed last time is greater than or equal to a second predetermined amount, and wherein the controller does not execute the forced supply mode in case that at least one of the above conditions (i) and (ii) is not satisfied.

2. The image forming apparatus of claim 1, wherein the accumulated amount of toner is third information, and the controller resets the third information after rotating the supply device in the forced supply mode.

3. An image forming apparatus comprising:

an image bearing member;

a developing device configured to develop an electrostatic image formed on the image bearing member, the developing device including a developer bearing member configured to carry a developer;

a supply device configured to supply toner to the developing device;

a density detector configured to detect information about a toner density as a ratio of toner and carrier of the developer of the developing device;

a transfer device configured to transfer an image developed by the developing device on a recording material; and a controller configured to execute a forced supply mode of performing the toner supply to the developing device from the supply device, wherein the controller interrupts an image forming operation and executes the forced supply mode when both of the following conditions (i) and (ii) are satisfied in a job in which image formation is continuously performed on a plurality of recording materials:

(i) a remaining supply amount obtained based on first information of at least one of detection results of the density detector and information about a toner consumption and second information concerning a driving amount of the supply device is greater than a first predetermined amount, (ii) an accumulated amount of toner consumed after the forced supply mode is executed last time is greater than or equal to a second predetermined amount, and wherein the controller does not execute the forced supply mode in case that at least one of the above conditions (i) and (ii) is not satisfied.

* * * * *